United States Patent [19]

Smith

[11] 4,452,289

[45] Jun. 5, 1984

[54] COMBINATION HAND GRIP AND BITS STORAGE

[75] Inventor: Lloyd T. Smith, Newton, Kans.

[73] Assignee: Fiskars Manufacturing Corporation, Wausau, Wis.

[21] Appl. No.: 335,076

[22] Filed: Dec. 28, 1981

[51] Int. Cl.[3] ..... B25G 1/08

[52] U.S. Cl. ..... 145/62; 145/61 R; 145/61 D

[58] Field of Search ..... 145/62, 61 D, 61 K, 145/61 M, 61 R, 61 A, 61 B, 61 C, 61 E

[56] References Cited

U.S. PATENT DOCUMENTS

| | | | |
|---|---|---|---|
| D. 33,589 | 11/1900 | Higgins | 145/62 |
| D. 37,923 | 3/1906 | Tower | 145/61 R |
| 148,057 | 3/1874 | Henry | 145/62 |
| 200,932 | 3/1878 | Parrish | 145/61 E |
| 264,527 | 9/1882 | Haley | 145/61 A |
| 264,798 | 9/1882 | Tyler | 145/61 C |
| 686,424 | 11/1901 | Smith | 145/62 |
| 1,499,184 | 6/1924 | Munson | 145/61 R |
| 1,694,559 | 12/1928 | Osgood | 145/61 K |
| 2,022,775 | 12/1935 | Holland-Letz | 145/62 |
| 2,472,392 | 6/1949 | Alexander | 145/62 |
| 2,539,532 | 1/1951 | Daniels | 145/62 |
| 2,871,899 | 2/1959 | Coyle et al. | 145/61 R |
| 3,189,069 | 6/1965 | Stowell | 145/61 R |
| 3,302,673 | 2/1967 | Forsberg | 145/61 R |
| 3,438,413 | 4/1969 | Borah | 145/61 A |
| 4,300,607 | 11/1981 | Mellinger | 145/62 |
| 4,372,361 | 2/1983 | Whiteford | 145/61 R |

*Primary Examiner*—Frederick R. Schmidt
*Assistant Examiner*—J. T. Zatarga
*Attorney, Agent, or Firm*—Schmidt, Johnson, Hovey & Williams

[57] ABSTRACT

A handle to be gripped when applying torque to hand tools employed in connection with fasteners such as screws, nuts and bolts, or for other uses, has a good, advantageous hand "feel" through the provision of a hollow body rigidified by an internal core, with the outer body having sufficient pliability to conform to the shape and size of the palm during each application of squeezing pressure. Special tread means on the tubular body augments its anti-slip characteristics, and the material forming the body well adapts it for the inclusion of an improved and convenient storage for bits.

6 Claims, 8 Drawing Figures

COMBINATION HAND GRIP AND BITS STORAGE

The underlying secret for effective application of torque to hand tools, such as screwdrivers, socket wrenches and the like, is not solely the strength required to effect the turning action; proper gripping of the handle is also essential. Once a good, firm, non-slipping grasp is made possible, no high degree of manual dexterity or turning force is required in order to apply the necessary torque even by those having small hands or minimal hand and arm strength. Or, stated otherwise, if the handle itself permits a proper grip, high resistance to turning can be overcome much more easily and quickly than is otherwise made possible through use of unsatisfactory handles.

Traditionally, handles made from wood have been widely accepted whereas the trend in contemporary hand tools is to use hard plastics which are, for the most part, quite slick, and therefore, not conducive to good anti-slip gripping. Multiple suggestions of various types of ribbing, fluting and grooving have come forth in an attempt to solve the problem, but none has the proper "feel" in the hand and none satisfies the long felt needs.

Rubber and other elastomers as materials for hand grips, e.g. for handle bars, as well as for hand tools are well known, not without some success, but the best advantages of such materials have not been taken and many of the necessary or desirable features of handles for hand tools remain wanting.

According to the principles of the present invention, therefore, the perception initially experienced upon grasping my improved handle is one of comfortable softness and yieldability to the squeezing action followed at once by a sensation of handle firmness as the hand force and pressure is increased. At the same time there is a comfortable feeling of conformation to the size and shape of the hand as well as an accompanying quality of elimination of disadvantageous slick, smooth surfacing.

More importantly, such perceptions are in no sense deceiving or of no consequence when the hand tool so equipped is placed in use. By the provision of a tubular body of suitable elastomeric material that is not only relatively soft, frictionable and deformable, backed up internally in combination with a stiff, hard core, I have been able to solve all of the problems above referred to. The handle has a double, frusto-conical configuration with the body encapsulating the core. A special end formation for the body adapts it for inclusion of bit storage cavaties. There is also provided means to preclude relative rotation of the body, the core and the tool shank, and use of novel, external flaps, for virtual elimination of slippage, reduces to a minimum calloused palms as is commonplace because of friction and pressure in connection with using handles of conventional hand tools.

Figure 1:
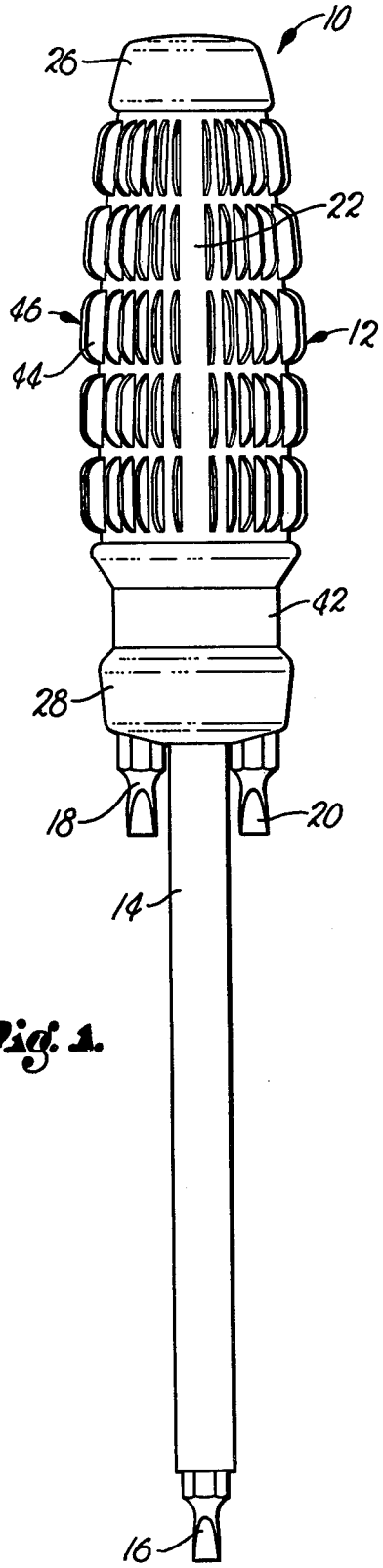
FIG. 1 is a side elevational view of a screwdriver provided with a handle made according to my present invention.
Figure 2:
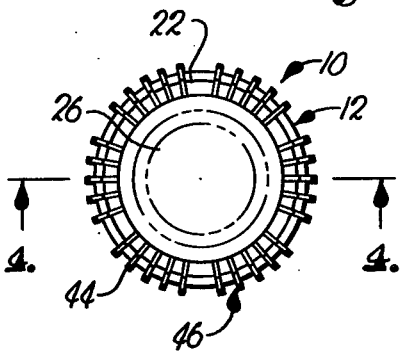
FIG. 2 is a view showing one end thereof.
Figure 3:
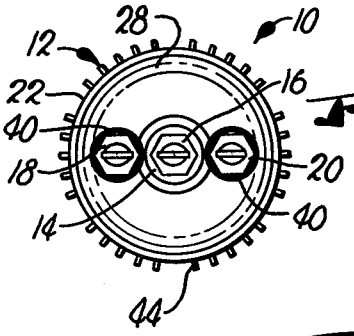
FIG. 3 is a view showing the opposite end thereof.
Figure 4:
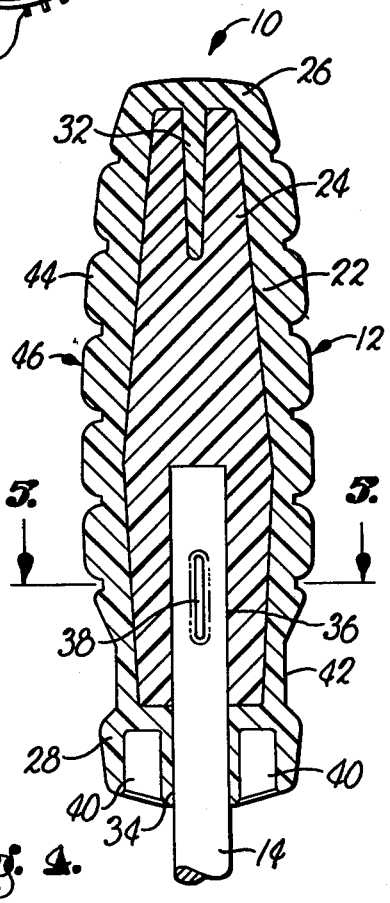
FIG. 4 is a fragmentary, cross-sectional view taken on line 4—4 of FIG. 2.

The hand tool chosen for illustration of the principles of the present invention is in the nature of a screwdriver 10 having a handle 12, a metallic tool shank 14 and a number of interchangeable bits 16, 18 and 20.

The handle 12 includes an elongated, relatively thick-walled tube 22 encapsulating an elongated, rigid anvil or filler core 24 extending from a smooth, dome-shaped cap 26 integral with the tube 22 at the free end of the latter to an enlarged closure head 28 integral with the tube 22 at the shank 14.

The transversely circular tube 22 is made from a soft, yieldable, self-sustaining material, e.g. a suitable elastomer, i.e. the synthetic rubbers and various plastics having elastic, rubber-like properties. On the other hand, the core 24 is relatively hard and may be selected from any one of a number of readily available plastics or other materials. It is to be preferred that the pliable tube 22 be molded tightly around the core 24 such that relative rotation of the resilient tube 22 and the core 24 is virtually eliminated.

Figure 6:
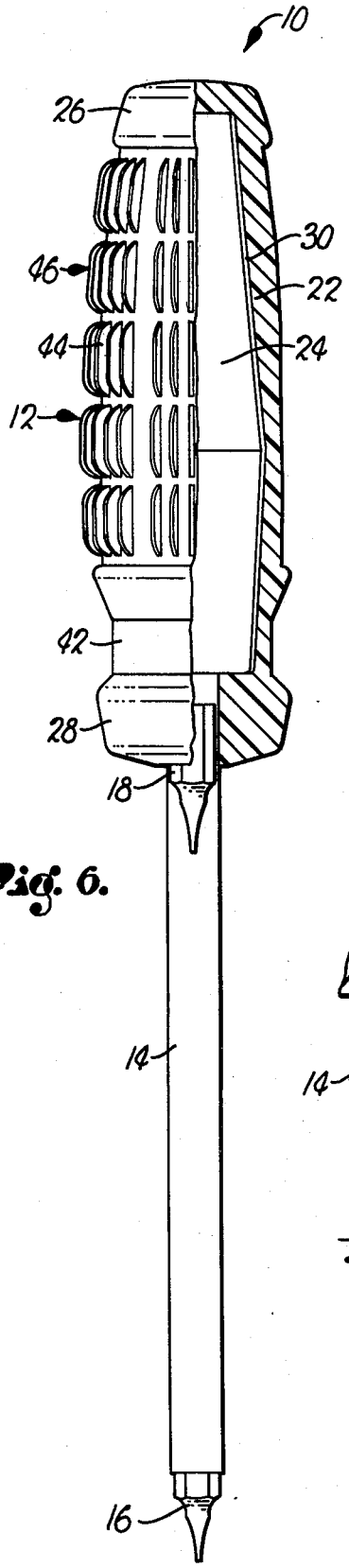
FIG. 6 is a view similar to FIG. 1, taken at a right angle thereto, parts being broken away to reveal details of construction.
Figure 5:
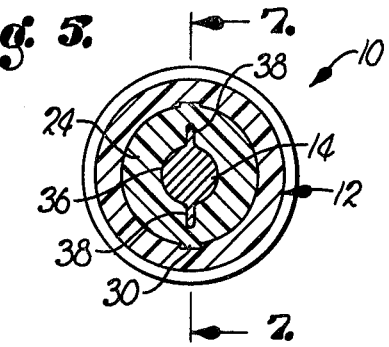
FIG. 5 is a cross-sectional view taken on line 5—5 of FIG. 4.

However, such prevention of relative rotation is assured by the provision of a pair of diametrically opposed ribs 30 extending radially outwardly and longitudinally of the core 24 throughout its length and formed integral therewith. The ribs 30 are tightly and entirely engaged by the tube 22 as best seen in FIGS. 5 and 6.

Any tendency for the tube 22 to become displaced laterally with respect to the core 24 is precluded by the provision of a centering prong 32 integral with the cap 26 and extending inwardly into the proximal end of the core 24. Also, the cross-sectional area of the handle 12 progressively increases in opposite directions as both the cap 26 and the head 28 are approached such as to cooperate with the cap 26 and the head 28 in precluding relative longitudinal shifting of the tube 22 and the core 24. With the handle 10 having various circumferential dimensions, it may be effectively grasped at selected zones by hands of various sizes.

The shank 14 extends through a centering clearance bore 34 in the head 28 and thence into a recess 36 in the core 24. A pair of diametrically opposed ears 38 integral with the shank 14 and molded into the core 24 preclude relative rotation of the shank 14 and the core 24. The ears 38 also prevent relative longitudinal movement of the shank 14 and the core 24, and cooperate with the internal flat end of the shank 14 in preventing movement of the handle 12 along the shank 14 toward its outer end when hand pressure is exerted on the cap 26, absorbed by the flat end of the core 24 at the prong 32.

Each bit 16, 18 and 20 has external flats, as shown, to prevent rotation in the shank 14 when inserted (see bit 16) into the outer end of the shank 14 having mating surfaces therein.

Figure 8:
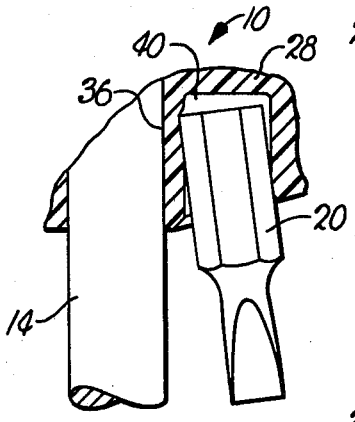
FIG. 8 is an enlarged, detailed view, partially in section, showing the method of removal of a bit stored in the handle.
Figure 7:
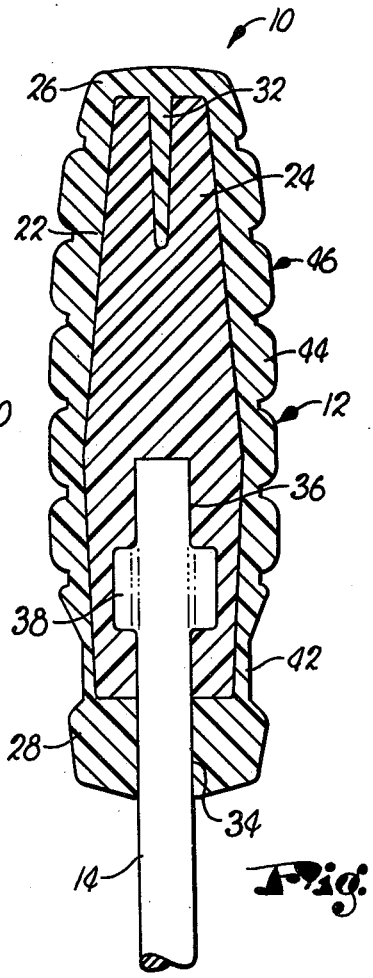
FIG. 7 is a fragmentary, cross-sectional view taken on line 7—7 of FIG. 5.

Those bit surfaces are frictionally received within storage cavities 40 in the smooth, frusto-conical head 28 alongside the shank 14 (see bits 18 and 20). This eliminates the need for clamps, retention springs holding caps or other moving parts as is commonplace in many tools. Moreover, the bits 18 and 20 are exposed to view and may be easily deflected for removal as shown in FIG. 8.

Except for the cap 26, the head 28 and an hourglass-shaped concavity 42 adjacent the head 28, the entire outer surface of the tube 22 is provided with a maze of spaced apart, essentially rectangular flaps 44 integral therewith. The flaps 44 are of substantially equal sizes and are arranged in five, spaced rows 46 circumscribing the tube 22.

Circumferentially of the tube 22, the flaps 44 are arranged to present six spaced sections of four flaps 44 in each row 46 respectively. The longitudinal axes of flaps 44 extend longitudinally of the tube 22 and their transverse axes normally extend radially of the tube 22. Each soft, frictional flap 44 is somewhat thin and quite flexible such as to readily bend at its line of joinder with the tube 22 in response to squeeze pressure within the palm of the hand, especially when torque is applied to the handle 12.

Accordingly, as distinguished from hard handles which injure the user's hands after use, no abrasion, pain or blisters are experienced during continued use of my handle 12. The thick, pliable material of the tube 22, which completely covers the core 24, conforms to the shape of the hand when squeezed, giving a comfort factor not found in prior torque applying hand tools. Aiding still further in providing increased grip, and thus turning power without abrasion are the flaps 44 which bend in the palm as squeezing, turning pressure is applied.

After each partial turn the grip may be released in the usual manner to reapply the hand, and within that interval, the tube 22 and the flaps 44 return to their original shape and position, all without need for the usual unsatisfactory ribbing of conventional handles. Each grip produces a different handle deformity and less squeezing power is required to effect the same torque power.

The handle 12 is also, of course, highly advantageous for use with single bit and ratcheting screwdrivers and with shanks other than as herein shown for turning tools differing from screwdriver bits.

The bit storage feature of my present invention is not without significance for the reasons above referred to, whether or not the hand gripping advantages are also incorporated into the handle.

I claim:

1. A handle for applying torque to a tool shank comprising:

an elongated, relatively thick-walled, transversely circular, resilient tube of soft, pliable, self-sustaining, yieldable, rubber-like, elastomeric material having elastic properties rendering the same subject, when grasped and squeezed by the human hand, to inward deformation to the shape and size of the palm of said hand and, upon release of hand pressure squeezing, to immediate return to the original size and configuration of the tube; and an elongated, relatively hard, rigid, shank-supporting core of plastic material secured to the tube therewithin for maintaining the handle against lateral bending when gripped and turned about its longitudinal axis, said tube having an integral cap at one end thereof and an integral closure head at its opposite end, said core being completely encapsulated within and tightly filling said tube in engagement with the cap and with the head, said core having a shank-receiving recess extending inwardly from said opposite end and terminating in a flat, uninterrupted surface in the core intermediate the cap and the head, said head having a centering, shank clearance bore aligned and registering with the recess, said head having a storage cavity extending inwardly thereinto from the other end thereof in parallelism with said bore adapted to frictionally receive a portion of a tool bit releasably attachable to the shank remote from the handle.

2. The invention of claim 1, said elastomeric material being yieldable to manual deflection of the bit laterally for augmenting easy release of the frictional engagement of the elastomeric material with the bit during pulling of the bit from said cavity.

3. A handle adapted for grasping by the human hand within the palm thereof for applying torque to the handle, said handle comprising an elongated body having:

a plurality of separate, thin, flexible, broad, flat, limber flaps integral with the body and normally extending freely and radially outwardly from the outer surface of the body, presenting a rough, outer, anti-slip, hand-gripping exterior, said flaps being arranged in a plurality of spaced rows circumscribing the body and being of elastomeric material rendering the same frictionable and yieldable circumferentially of the body to hand pressure whereby, when the flaps are gripped and squeezed by the hand, they will fold toward said outer surface such that said exterior conforms to the shape of the hand.

4. The invention of claim 3, said flaps being rectangular, presenting thin end edges normally extending radially outwardly of the tube and outer, thin, longitudinal edges longitudinally of the body.

5. The invention of claim 4, said flaps being self-sustaining adapting the same for return to their normal, radially-extending position upon release of hand pressure thereon.

6. In a hand tool, a handle; and a bit-receiving shank secured to the handle and extending outwardly beyond one end thereof, said handle having a cavity adapted for receiving a bit and holding the same in place by frictional engagement therewith, the bit extending outwardly beyond the cavity for visibility and for grasping when removing the same from the cavity, said cavity extending into said one end of the handle alongside the shank, said handle being of soft, yieldable material capable of flexing during lateral tilting of the bit while the same is pulled out of the cavity.

* * * * *